US006992612B2

(12) United States Patent
Pessina et al.

(10) Patent No.: US 6,992,612 B2
(45) Date of Patent: Jan. 31, 2006

(54) INFRARED HAND-HELD REMOTE CONTROL

(75) Inventors: Michael W. Pessina, Allentown, PA (US); Jason Killo, Emmaus, PA (US); Elliot G. Jacoby, Glenside, PA (US); Joel S. Spira, Coopersburg, PA (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 572 days.

(21) Appl. No.: 10/142,146

(22) Filed: May 7, 2002

(65) Prior Publication Data

US 2003/0015302 A1 Jan. 23, 2003

Related U.S. Application Data

(60) Provisional application No. 60/289,066, filed on May 7, 2001.

(51) Int. Cl.
*G08C 17/00* (2006.01)

(52) U.S. Cl. ..... 341/176; 361/205; 700/17; 318/466

(58) Field of Classification Search ..... 340/825.72; 341/176; 315/29.5, 12.9, 149; 701/50; 160/310; 318/466
See application file for complete search history.

(56) References Cited

U.S. PATENT DOCUMENTS 3,697,821 A * 10/1972 Johnson ..... 361/205
5,962,992 A 10/1999 Huang et al.
6,100,659 A * 8/2000 Will et al. ..... 318/466
6,300,727 B1 * 10/2001 Bryde et al. ..... 315/294

FOREIGN PATENT DOCUMENTS

EP 0503699 A1 2/1992
WO WO0040057 7/2000

OTHER PUBLICATIONS

Notification of Transmittal and International Search Report dated Oct. 9, 2002 for PCT/US02/14688.
International Search Report dated May 29, 2000 for PCT/US99/28964.

* cited by examiner

*Primary Examiner*—Michael Horabik
*Assistant Examiner*—Hung Dang
(74) *Attorney, Agent, or Firm*—Ostrolenk, Faber, Gerb & Soffen, LLP

(57) ABSTRACT

An infrared hand-held remote control for handling a single or plural devices such as lights, shades, drapes and the like contains ergonomically selected and placed control buttons that are self-describing and easy to use. It allows explicit, easy-to-use control of different functions by providing for each function to be controlled vertically disposed discrete buttons that provide "all or nothing" control of some physical feature and similar, vertically disposed and horizontally aligned "adjust" buttons that allow for fine and continuous control of the physical quantities between the extremes or limits of the discrete button functions. Successive groups of buttons provide for the control of different appliances or devices, where each group of buttons is identified by easy to comprehend icon or alphabetic representations.

42 Claims, 21 Drawing Sheets

INFRARED HAND-HELD REMOTE CONTROL

CROSS REFERENCE TO RELATED APPLICATION

This application claims priority and is entitled to the filing date of U.S. Provisional application Ser. No. 60/289,066 filed May 7, 2001 and entitled "Infrared Hand-Held Remote Control", the content of the provisional patent application being incorporated by reference herein.

BACKGROUND OF THE INVENTION

The present invention generally relates to remote controls for appliances such as lights, shades, etc., and, more particularly, relates to ergonomically improved remote controls that are operable with one or several or a variety of appliances.

Remote controls for appliances are ubiquitous. Many existing remote controls incorporate and provide a large array of buttons, functions and features which present a daunting challenge to a new user, all the more so in this age where we are constantly exposed to a very large variety of new electronic devices and need to master and learn them all. A fundamental aspect of the present invention is that it provides a remote control for home and office based appliances such as lights, window shades and the like that are particularly ergonomic from the point of view that it enables mastering its working and functionality without having to resort to complex and lengthy manuals or instruction books or the investment of precious time to visually study the remote control.

The basic construction of remote controls, including remote controls that operate in the infrared electromagnetic spectrum are known in the art. For example, U.S. Pat. No. 5,987,205 entitled "Infrared Energy Transmissive Member and Radiation Receiver" which has issued to the assignee of the present invention describes preferred embodiments of circuits and other features of a remote control. The content of the aforementioned U.S. Pat. No. 5,987,205 are incorporated by reference herein. An appliance that can be controlled with the infrared hand-held remote control of the present invention is described in the present assignee's U.S. Pat. No. 5,467,266 and U.S. Pat. No. 5,671,387, and the contents of these two patents are incorporated by reference herein as well.

SUMMARY OF THE INVENTION

A general object of the present invention is to provide a more advanced and ergonomically constructed hand-held remote control for home and office based appliances.

It is another object of the present invention to provide an ergonomic, hand-held remote control that is operable in the infrared band of the electromagnetic spectrum and which contains all the information on a face plate thereof that is necessary to immediately comprehend the features and functionality thereof.

It is another object of the present invention to provide an ergonomic, hand-held infrared remote control for multiple devices having a lower intellectual transaction level than typical prior art controls.

The foregoing and other objects of the invention are realized with an infrared hand-held remote control device that is implemented as an ergonomic control device for the setting of a given single variable property of a structure between a maximum setting and a minimum setting; said structure having a control input connected thereto for adjusting said variable property to any of a plurality of settings between said maximum and minimum settings; said control device having first, second, third and fourth separate manually operable control elements which are operatively connected to said control input; said first and second control elements being operable to set said variable property of said structure at said maximum setting and said minimum setting respectively; said third and fourth control elements being vernier controls and being respectively operable to adjust said variable property from said maximum setting and toward said minimum setting, and to any of said plurality of settings and from said minimum setting and toward said maximum setting and to any of said plurality of settings.

The control device may be a portable hand-held unit with an infrared coupling system to couple the control device to the control input and the control elements are preferably arrayed over the surface of the portable hand-held unit for manual operation by a user. The underlying electronics can be configured so that only a single one of said first, second, third and fourth control elements are individually operable at any time to initiate the setting of said variable property. The control elements can be depressable switch elements. At least one second structure can be provided separate from the first-mentioned structure. It has a respective single variable second property and fifth, sixth, seventh and eighth control elements that are identical to said first, second, third and fourth control elements, respectively, for controlling said variable property of said second structure in a process identical to the control of said first-mentioned variable structure. The first structure can be a lamp and the variable property, its luminous output. The second structure can be a motor-operated window covering or shade or the like, and its variable property may be its amount of openness.

Preferably, the first and third control elements are laterally adjacent one another and the second and fourth control elements are laterally adjacent to one another. The first control element is disposed vertically above the second control element, whereby the operation of said control elements is easily discernable to a user from the placements of said control elements.

Preferably, the remote control device can operate a single structure or appliance, or several different such structures or appliances. The control device can also be configured with preset buttons that enable the control device to set the physical property to a location or value between the maximum setting and the minimum setting.

As described above, the present invention realizes a concept for an ergonomic infrared hand-held remote control that allows explicit, easy-to-use control of different functions. A salient feature of the idea is to provide vertically disposed discrete buttons, that is, buttons that provide "full limit" control of some variable features. Located in horizontally adjacent relation to the discrete buttons are "adjust" buttons. These buttons allow fine or continuous control of the physical quantities between the extremes or limits of the discrete button functions.

Other features and advantages of the present invention will become apparent from the following description of the invention which refers to the accompanying drawings.

DETAILED DESCRIPTION OF PREFERRED EMBODIMENTS

Figure 1:
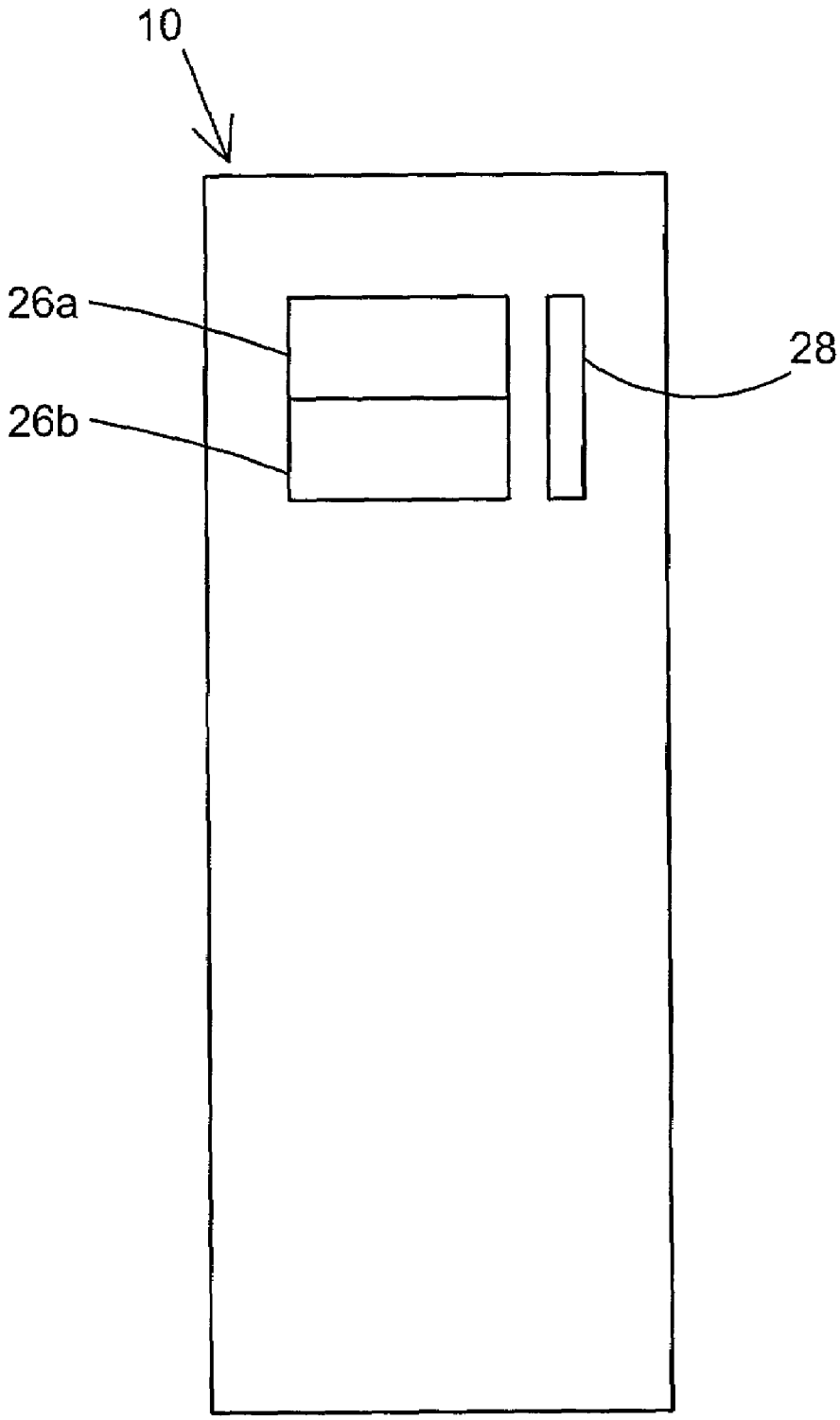
FIG. 1 (PRIOR ART)
FIG. 1 shows a prior art infrared hand-held remote control.

Referring to the drawings, FIG. 1 illustrates a prior art infrared hand-held remote control 10 which is manufactured and sold by the assignee of the present invention. It features two large buttons 26*a* and 26*b* disposed in vertical arrangement on the left side of the control. These buttons 26*a* and 26*b* comprise on and off controls for a light or open and close commands for a shade. Immediately to the right of these buttons, is a slim vertically disposed rocker button 28. This button may be "rocked" forward and back to cause the light to brighten or dim or the shades to open or close in a continuous fashion between the two extremes that are controlled by the on and off (or the open and close buttons) buttons 26*a* and 26*b*.

Figure 2C:
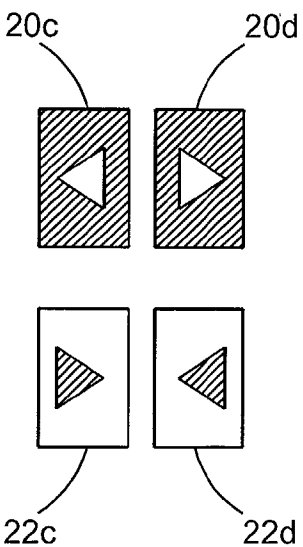
FIGS. 2A, 2B and 2C show different button appearances for the "adjust" buttons of the device of FIG. 2 and various decals or legend choices therefor.
Figure 2B:
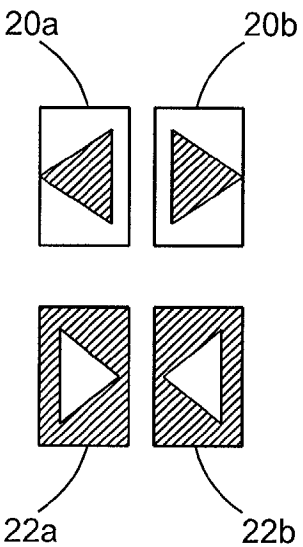
Figure 2A:
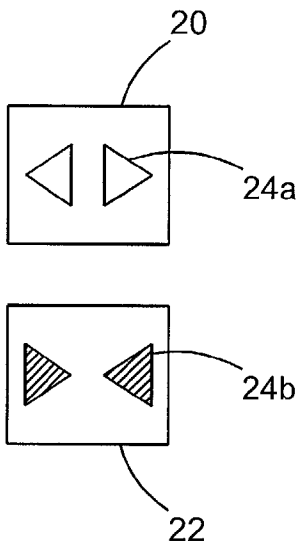
Figure 2:
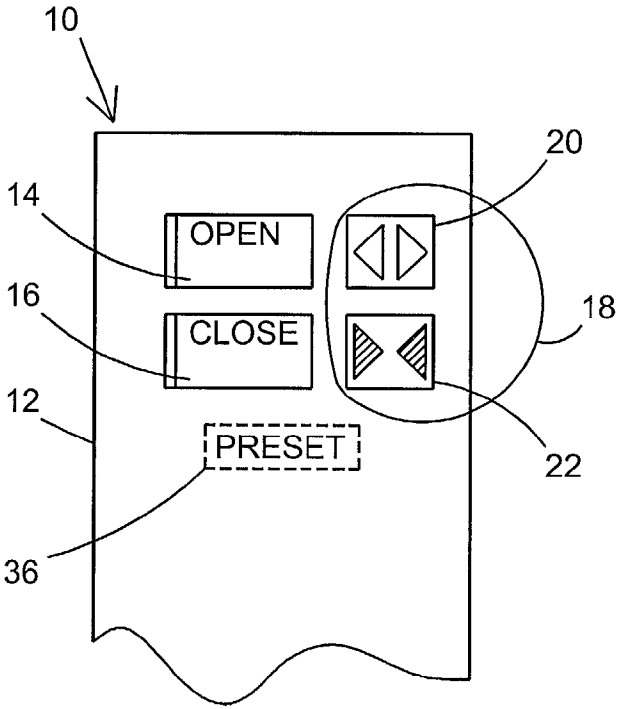
FIG. 2 shows a first embodiment of hand-held remote control in accordance with the present invention.

Referring to FIG. 2 the invention aims at providing a more ergonomic set of button controls for an otherwise conventional infrared hand-held remote control such as the control 10 of FIG. 1. In FIG. 2, a distinct "open" button 14 and a corresponding "close" button 16 are vertically aligned and these discrete buttons, that provide "full limit" control of some variable physical feature, are accompanied by a pair of horizontally adjacent and vertically aligned "adjust" buttons 20 and 22. Adjacent buttons 20, 22 are shown encircled by 18 solely for the purposes of the present description so as to provide a reference to other implementations thereof that are illustrated in FIGS. 2A, 2B and 2C.

Thus, in FIG. 2A, the button 20 features a self-describing symbol or icon in the form of arrows or triangles for indicating such functions as open and the button 22 features a self-describing symbol in the form of arrows or triangles for indicating such functions as close. These icon symbols 24*a* and 24*b* can be represented as white on black or black on white symbols. Further, the button 20 can have two separate icons 20*a*, 20*b* and the button 22 can have two separate icons 22*a*, 22*b* (FIG. 2B) or the button 20 can have two separate icons 20*c*, 20*d* and the button 22 can have two separate icons 22*c*, 22*d* (FIG. 2C). Any of the arrangements of FIGS. 2A–2C can be selected for the embodiment of FIG. 2 and the other embodiments described below.

Figure 3:
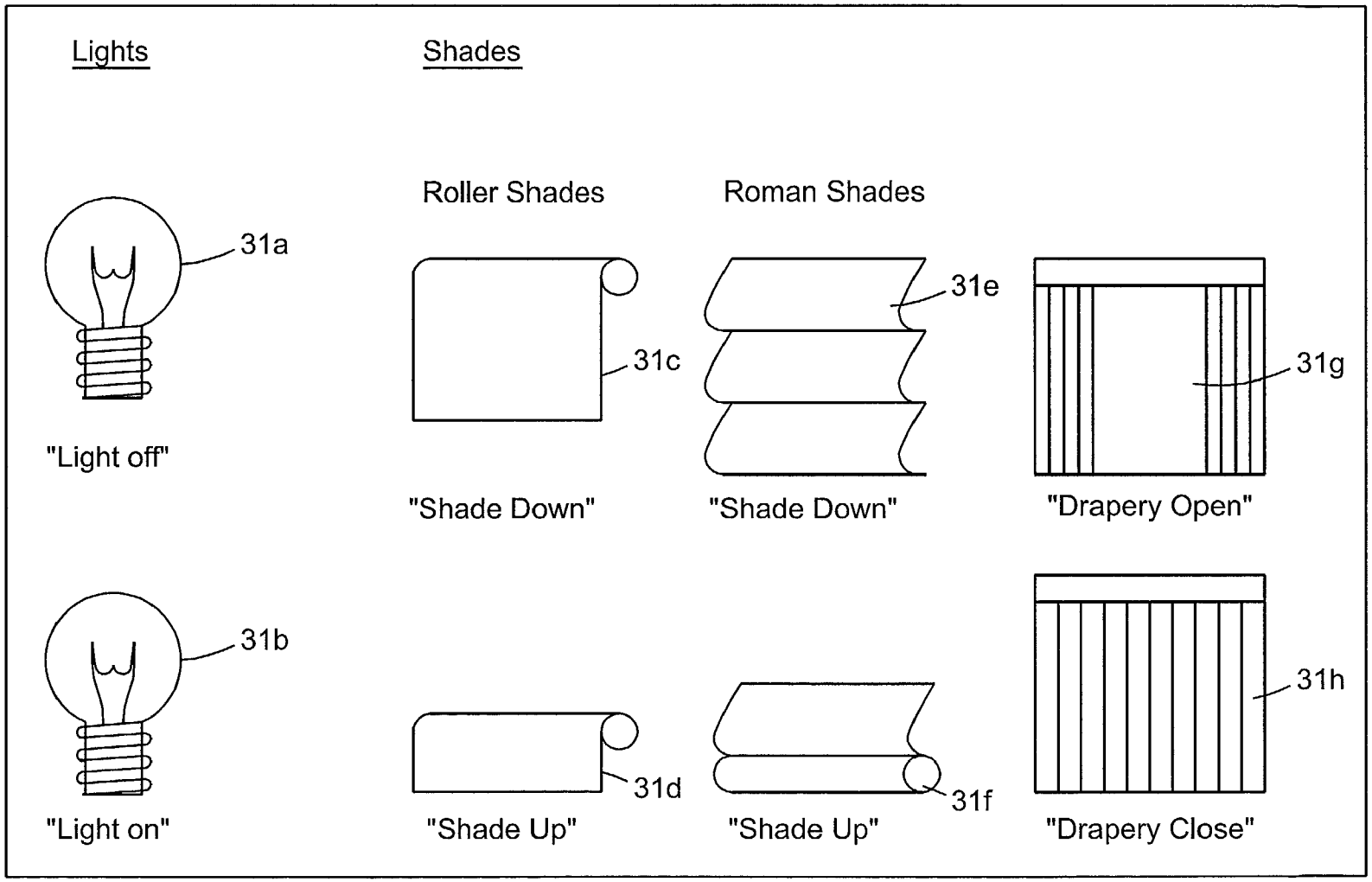
FIG. 3 shows further button shapes and/or decals for the remote control.
Figure 3A:
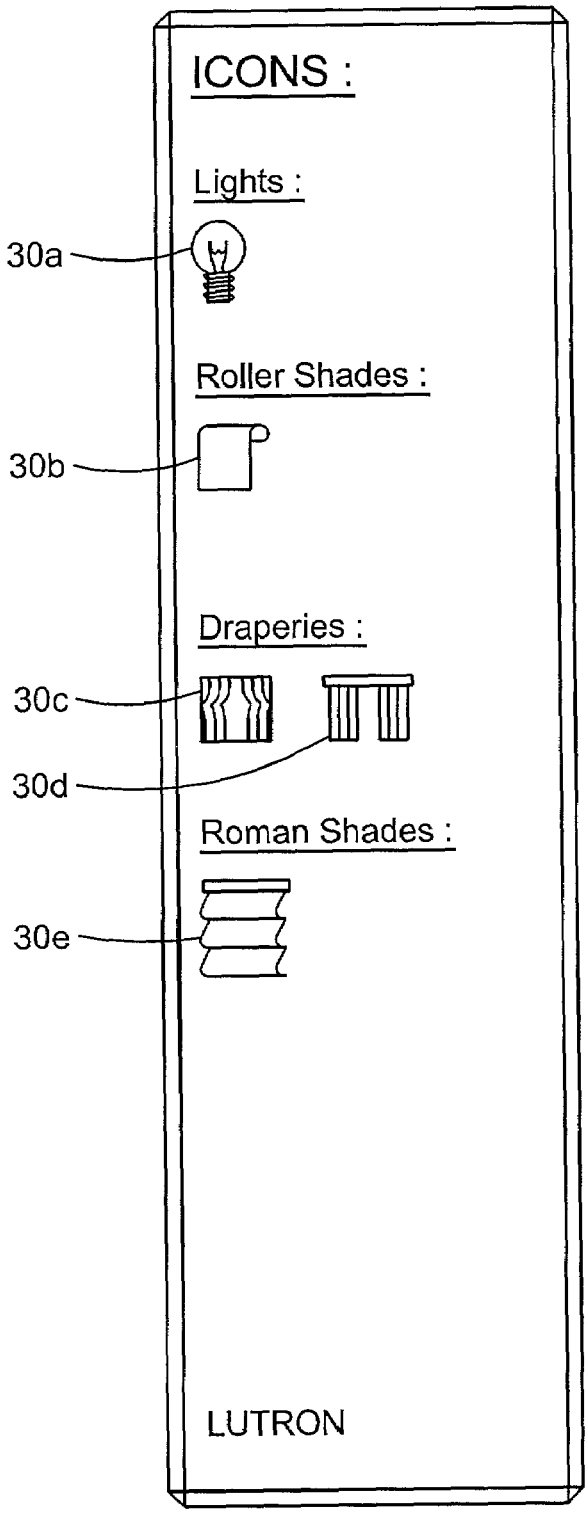
FIG. 3A shows pictorial decals useable with the hand-held device of FIG. 2.

FIG. 3A shows a variety of useable icons such as 30*a* for lights, 30*b* for roller shades, 30*c* and 30*d* for draperies and 30*e* for roman shades. These icons can be incorporated into the remote control 10 shown in FIG. 3B which is provided to control three appliances including drapes, roller shades, and lights. Thus, the icons 30*c*, 30*b* and 30*a* are placed adjacent open and close buttons 14 and 16 and the accompanying adjust buttons 20 and 22. A corresponding icon is located adjacent the open and close buttons 14*a* and 16*a* as well as adjust buttons 20*e* and 22*e* for the drapes. The remote control of FIG. 3B also provides buttons 14*b* and 16*b* and accompanying adjust buttons to control lights. In all cases the on/off buttons are vertically aligned and symmetrically arranged relative to similarly, vertically aligned adjust buttons.

Figure 3B:
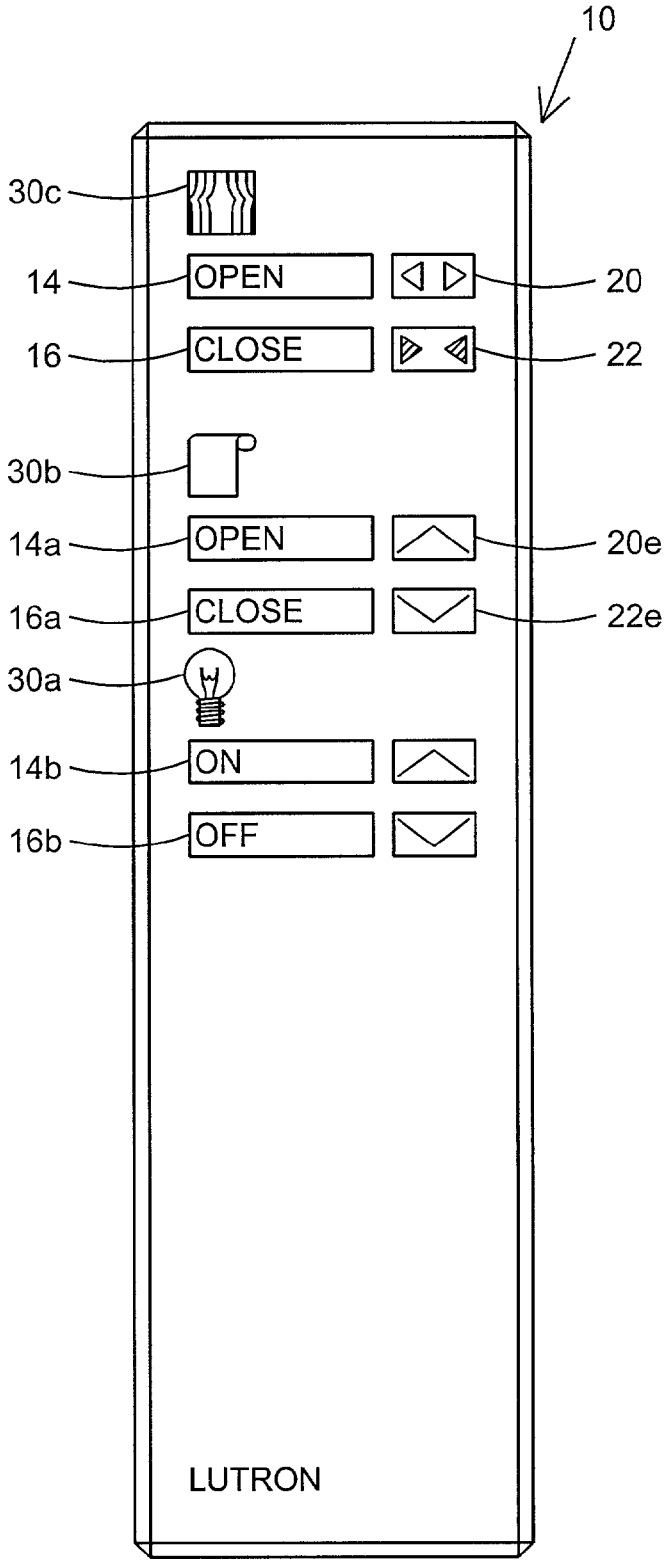
FIG. 3B shows a further embodiment of the hand-held remote control of the present invention which is operable to control a variety of appliances.
Figure 4:
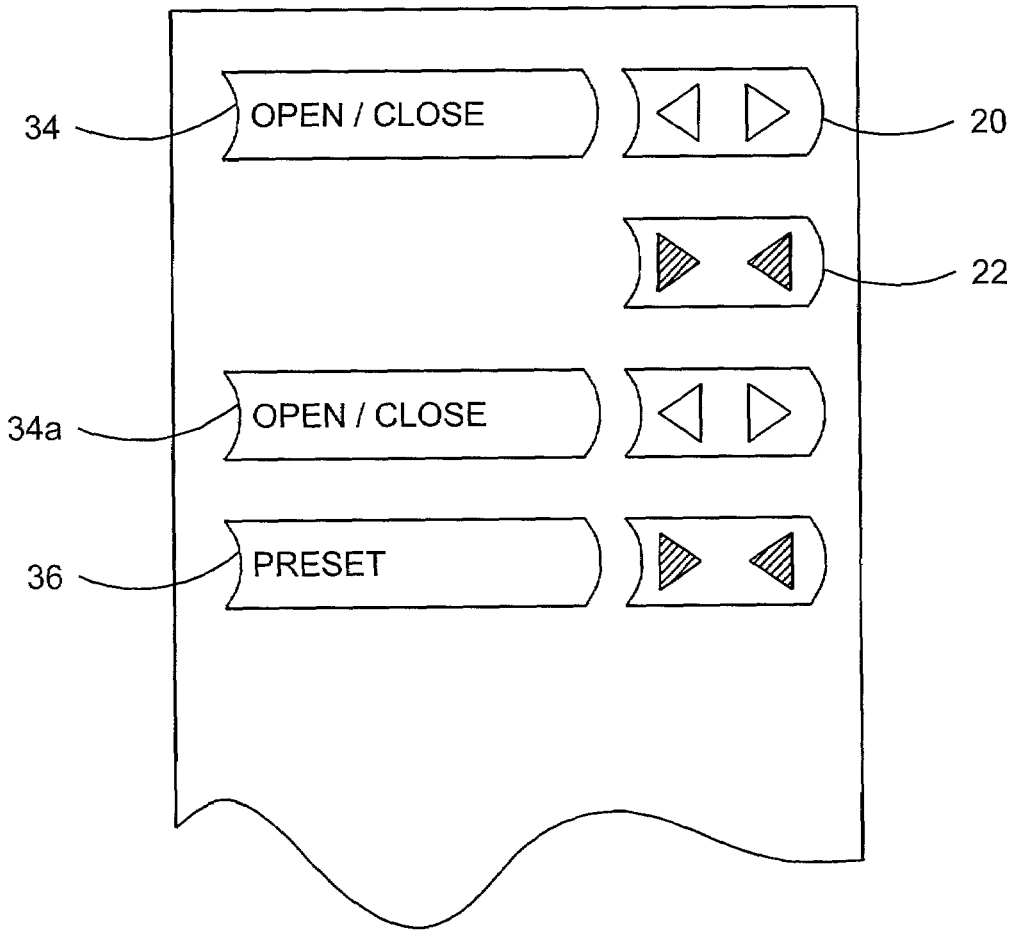
FIG. 4 shows a further embodiment of the present invention.

The button arrangement for the hand-held control shown in FIG. 4 retains the vertical and horizontal alignment of the adjust buttons 20, 22 but replaces the dual buttons 14, 16 of the embodiment of FIG. 3B with a single button 34 which is designed (together with the electronics within the remote control 10) to provide alternate action on and off or open and close commands for the light, shade, etc. In addition, the control of FIG. 4 provides for at least one of the appliances being controlled via a "preset" button 36 which, when actuated, automatically selects a particular adjust position, e.g., a light output level or roller shade position, etc.

Figure 5A:
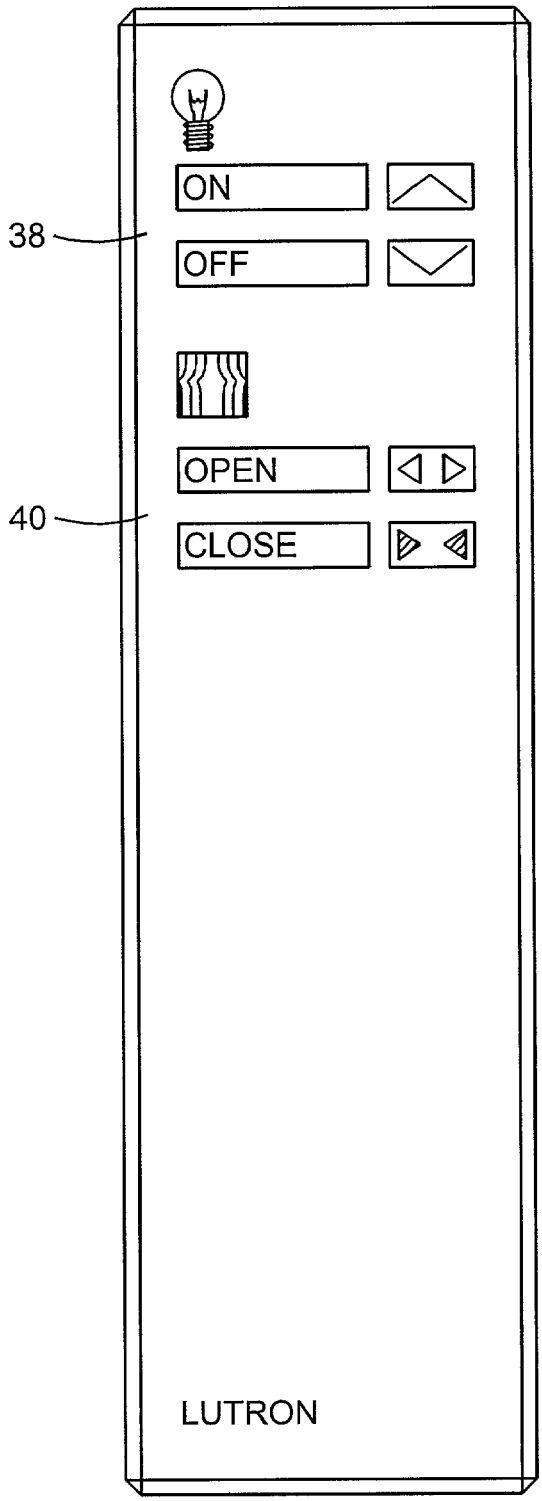
FIGS. 5A, 5B and 5C show different appliance menus and decals in accordance with the present invention.
Figure 5B:
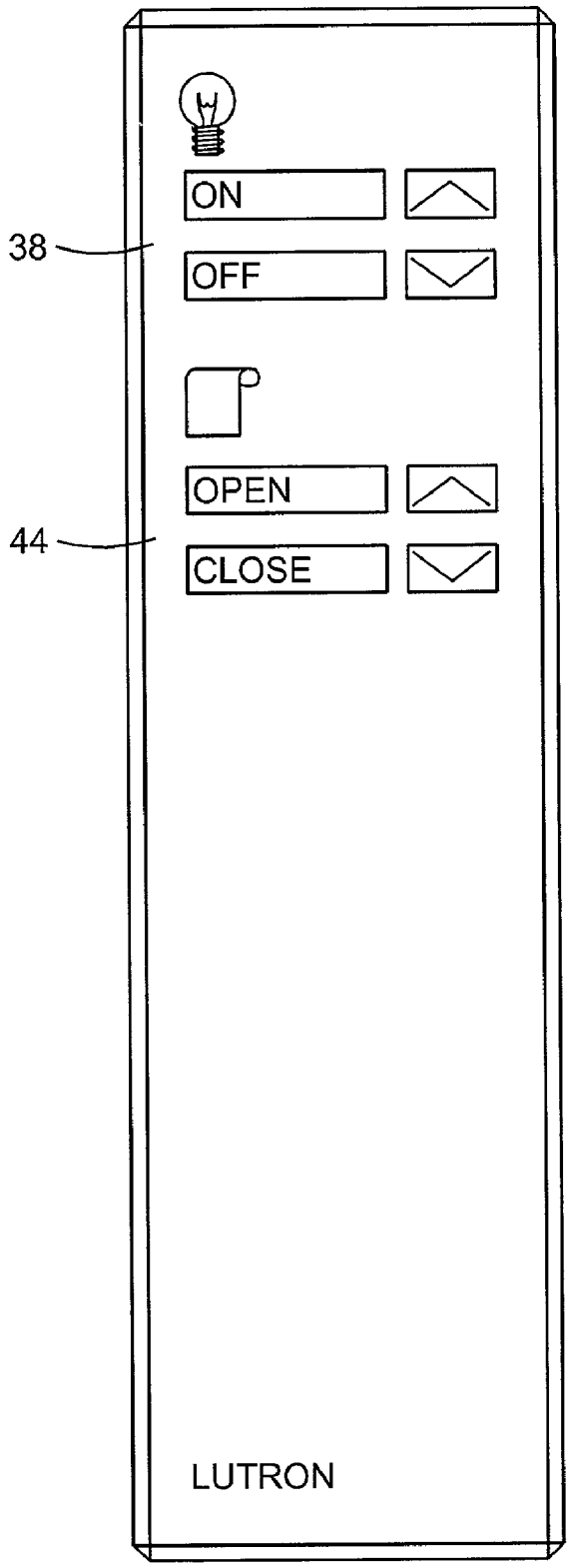
Figure 5C:
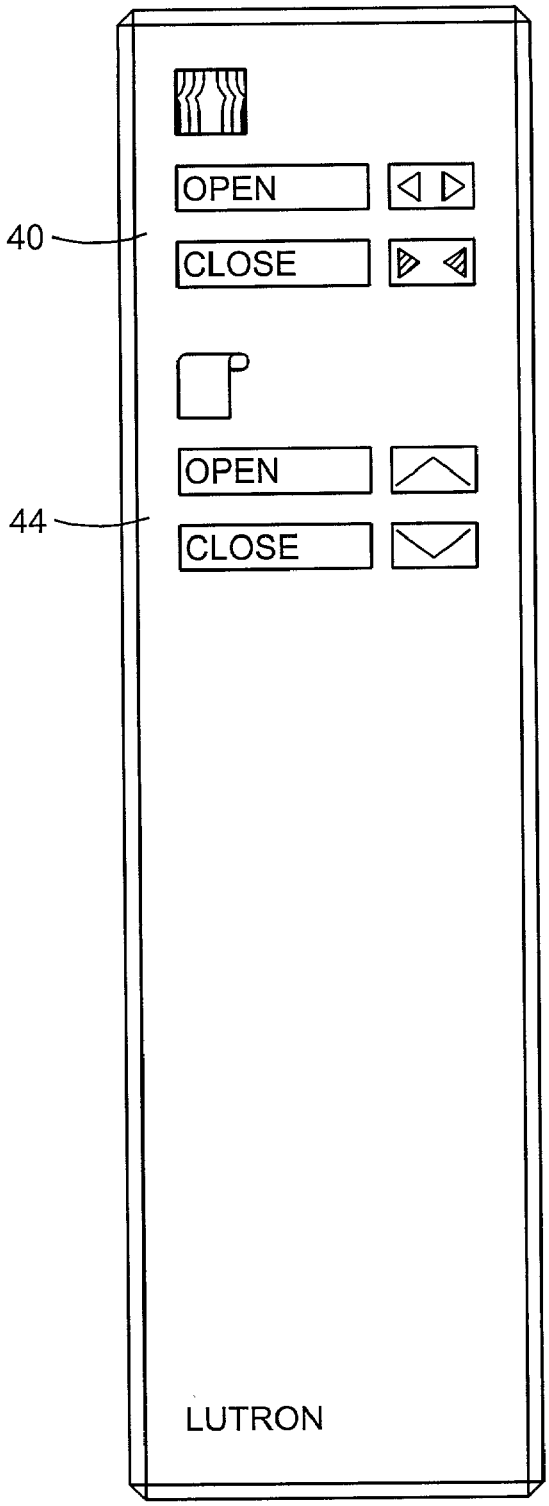

With reference to FIGS. 5A, 5B and 5C, appliance button groups 38, 40 and 44 provide remote controls for different appliance groups to be controlled with a single controller, such as lights and drapes in FIG. 5A, or lights and roller shades in FIG. 5B or drapes and roller shades as illustrated in FIG. 5C.

Figure 6A:
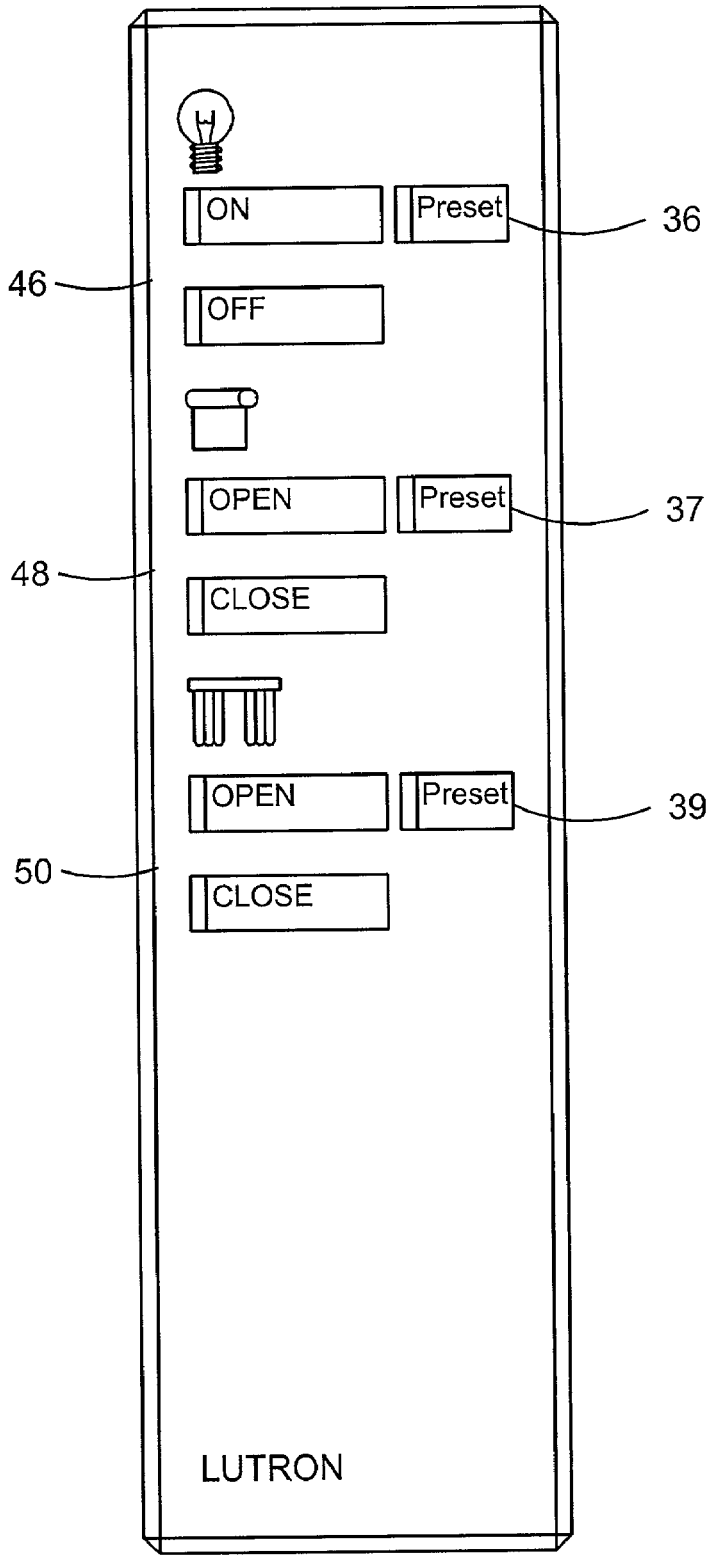
FIGS. 6A and 6B show another embodiment of the present invention that provides fully on and fully off control in conjunction with preset controls for a plurality of appliances.

FIGS. 6A–6D show further ergonomic button arrangements for infrared hand-held remote controls, including, in FIG. 6A, three button groups 46, 48 and 50, to control, respectively, lights, roller shades and drapes, including within each of the groups a respective preset button 36, 37 and 39 which replaces the "adjust" buttons previously described. By depressing any of these preset buttons 36, 37, 39, the light or shade assumes a preset output level or roller shade and drape "preset" position.

The preset buttons 36, 37, 39 can be preset at the factory for particular settings or they may be programmable such as by depressing them sufficiently long, e.g., three seconds or more, whereby the underlying electronics would then start continuously adjusting the particular light level or roller position, etc., and when the preset button is released, the "preset" position is stored.

Figure 6B:
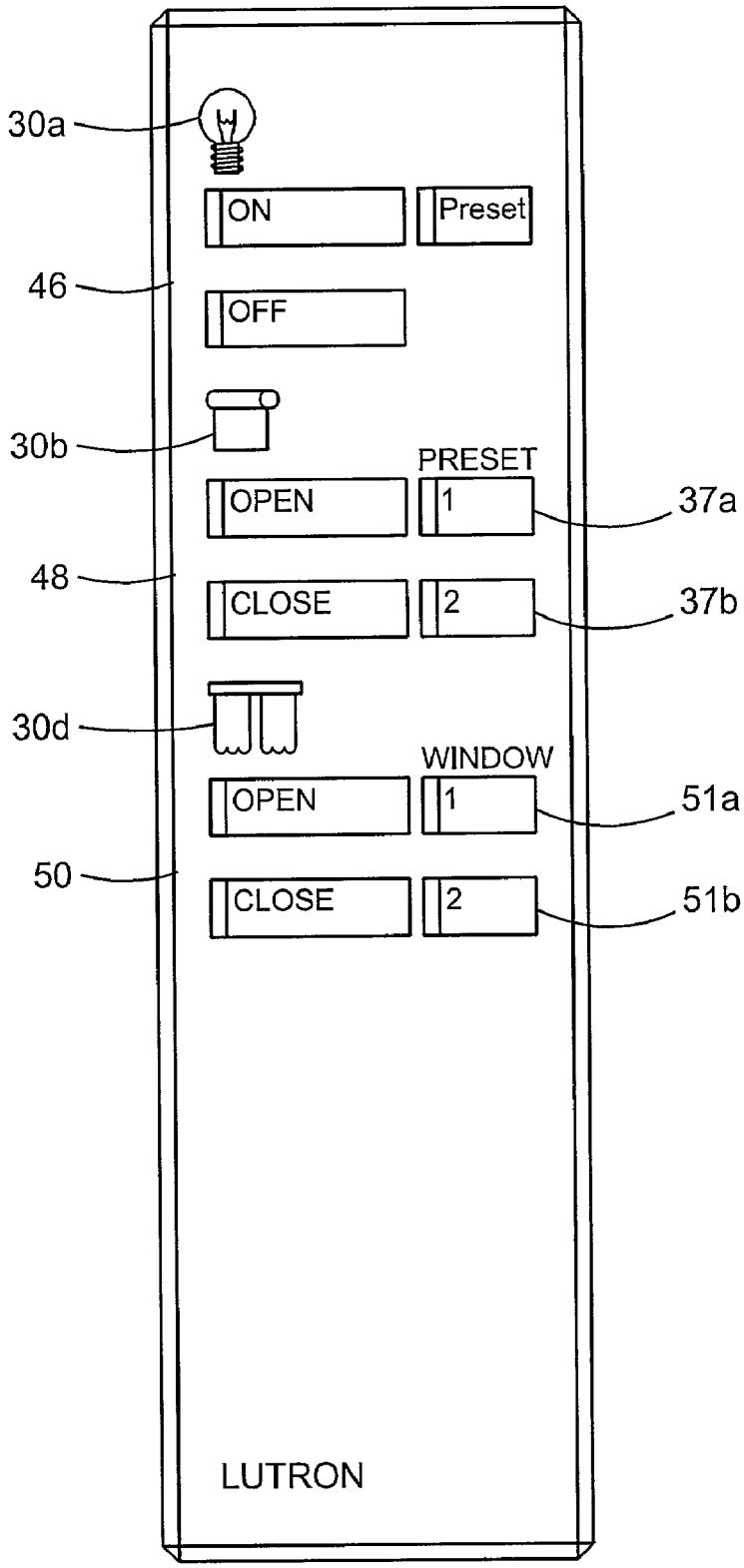

The variation presented in the embodiment of FIG. 6B provides a pair of preset buttons 37*a* and 37*b* for the roller shades of a control of FIG. 6A to enable selection of two separate preset positions and further provides "select" buttons 51*a* and 51*b* for the drape button group 50 of FIG. 6A. These buttons 51*a*, 51*b* allow an operator to select which window drapes are selected to be controlled by the remote control.

Figure 6C:
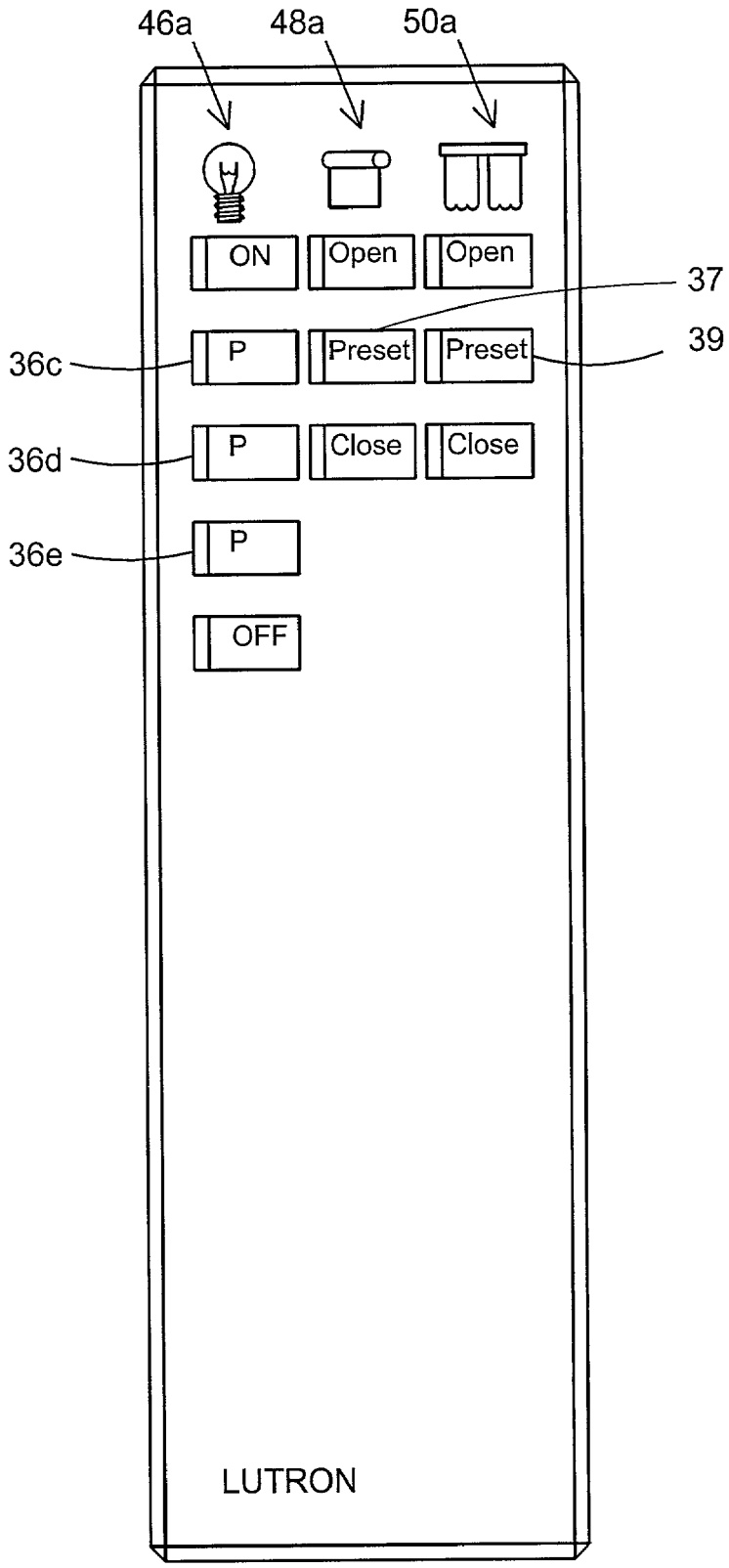
FIGS. 6C and 6D show a further embodiment of the invention involving different ergonomically selected button placements.

Yet another button arrangement is shown in FIG. 6C in which both the on/off and open/close buttons are still vertically aligned but are now vertically separated by locating the preset buttons in vertical alignment therewith, as indicated by the preset buttons 39, 37 and 36*c*, 36*d* and 36*e*. The buttons 36*c*, 36*d* and 36*e* provide several preset positions for the lights so that one can readily select between three preset positions without having to adjust or reprogram the preset buttons.

Figure 6D:
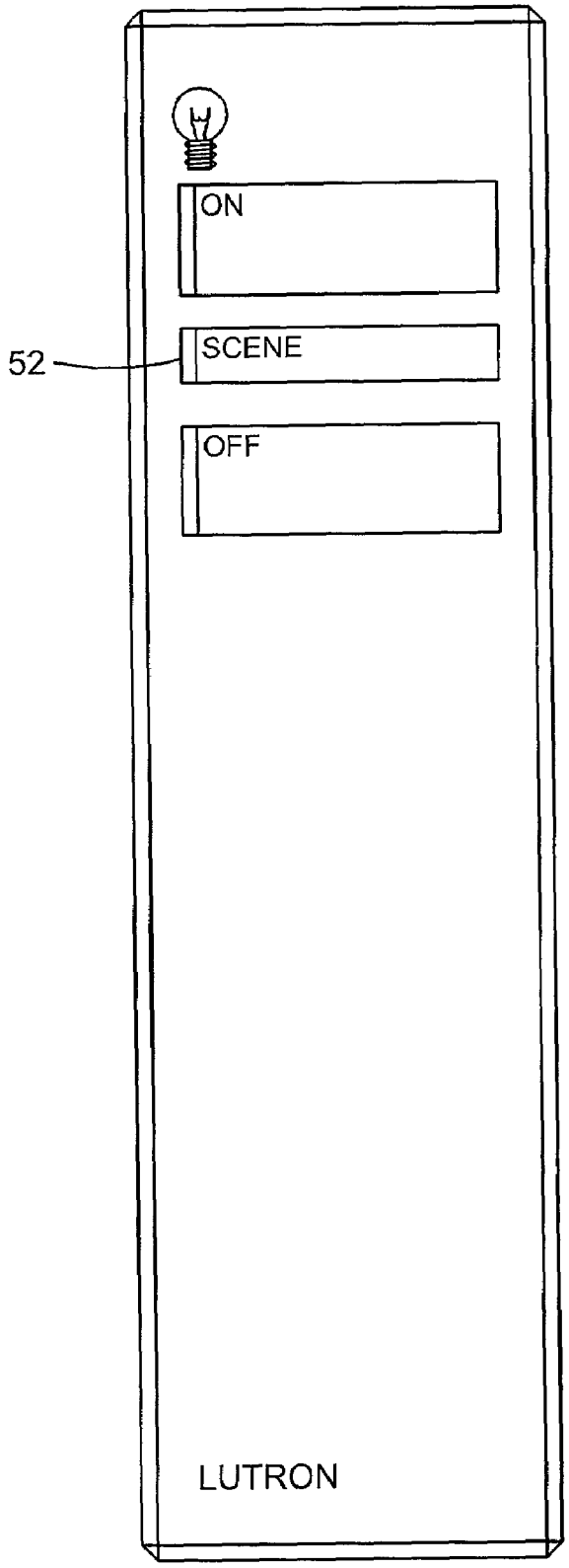

In the embodiment of FIG. 6D a scene control button 52 is provided in vertical alignment with the on/off buttons.

Figure 7A:
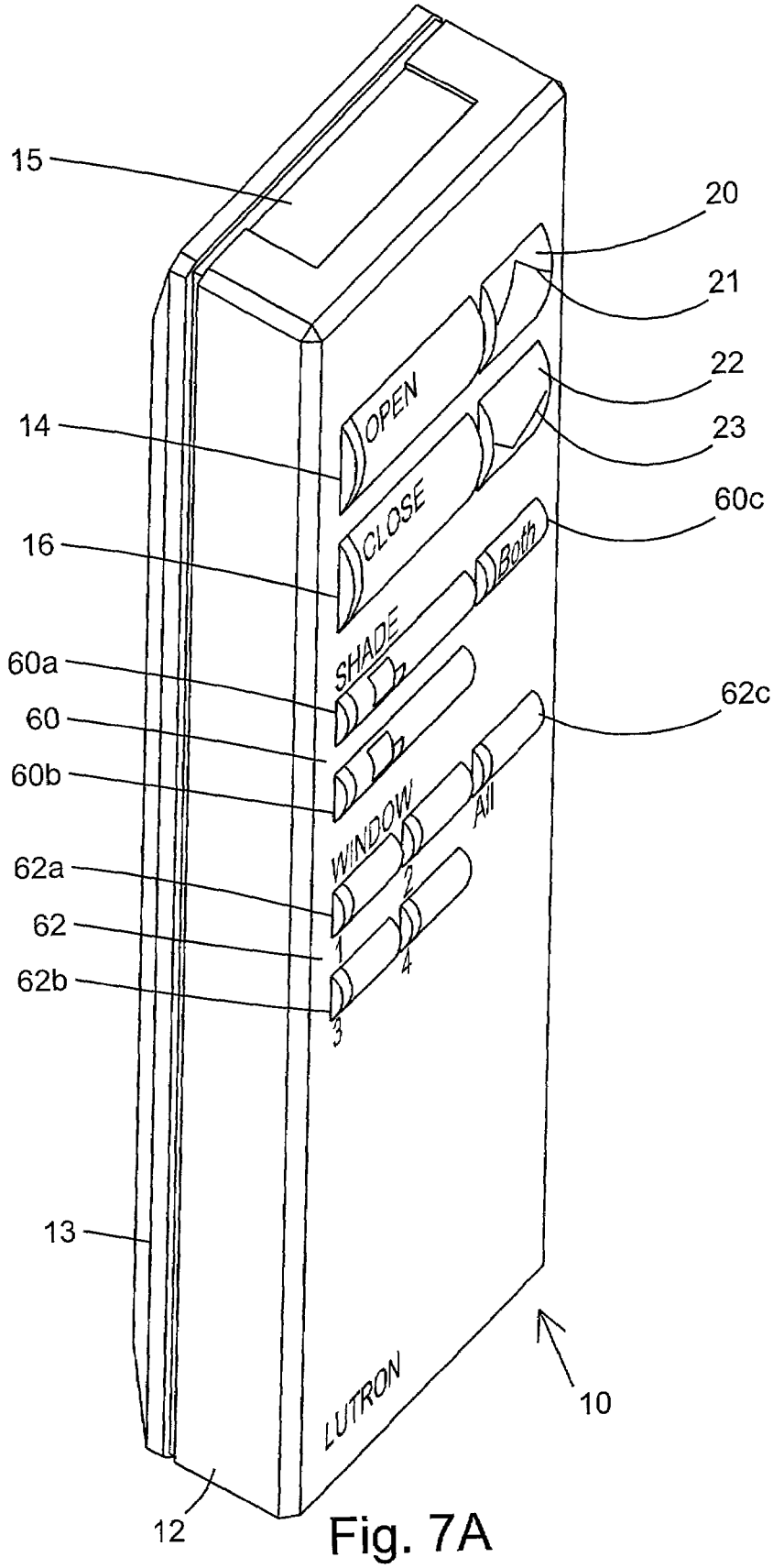
FIGS. 7A–7F illustrate perspectively and in plan views a plurality of hand-held remote control buttons and their decals for controlling single or plural appliances.

A further embodiment of the hand-held remote of FIG. 2 is perspectively illustrated in FIG. 7A. The remote control 10 is depicted here to show its body 12, infrared window 15 and rear panel 13. This device has been configured to control a shade with the open and close buttons 14, 16 which are vertically aligned as well as located horizontally adjacent to the adjust buttons 20 and 22 which carry the up arrow icon 21 and the down arrow icon 23 formed directly on the adjust buttons 20 and 22.

The illustrated remote control is further developed to provide a group 60 of shade selection buttons as well as a switch group 62 comprising window select buttons. The button group 60 includes a first shade and second shade select button 60*a* and 60*b*, respectively, as well as a "both" button 60*c* that allows the device to simultaneously control one or another or two shades. The button group 62 allows for the selection of one or more or all (button 62*c*) of the windows where various shades are located for being controlled with the single remote control 10 of FIG. 7A. The device of FIG. 7A is shown in plan view in FIG. 7B.

Figure 7B:
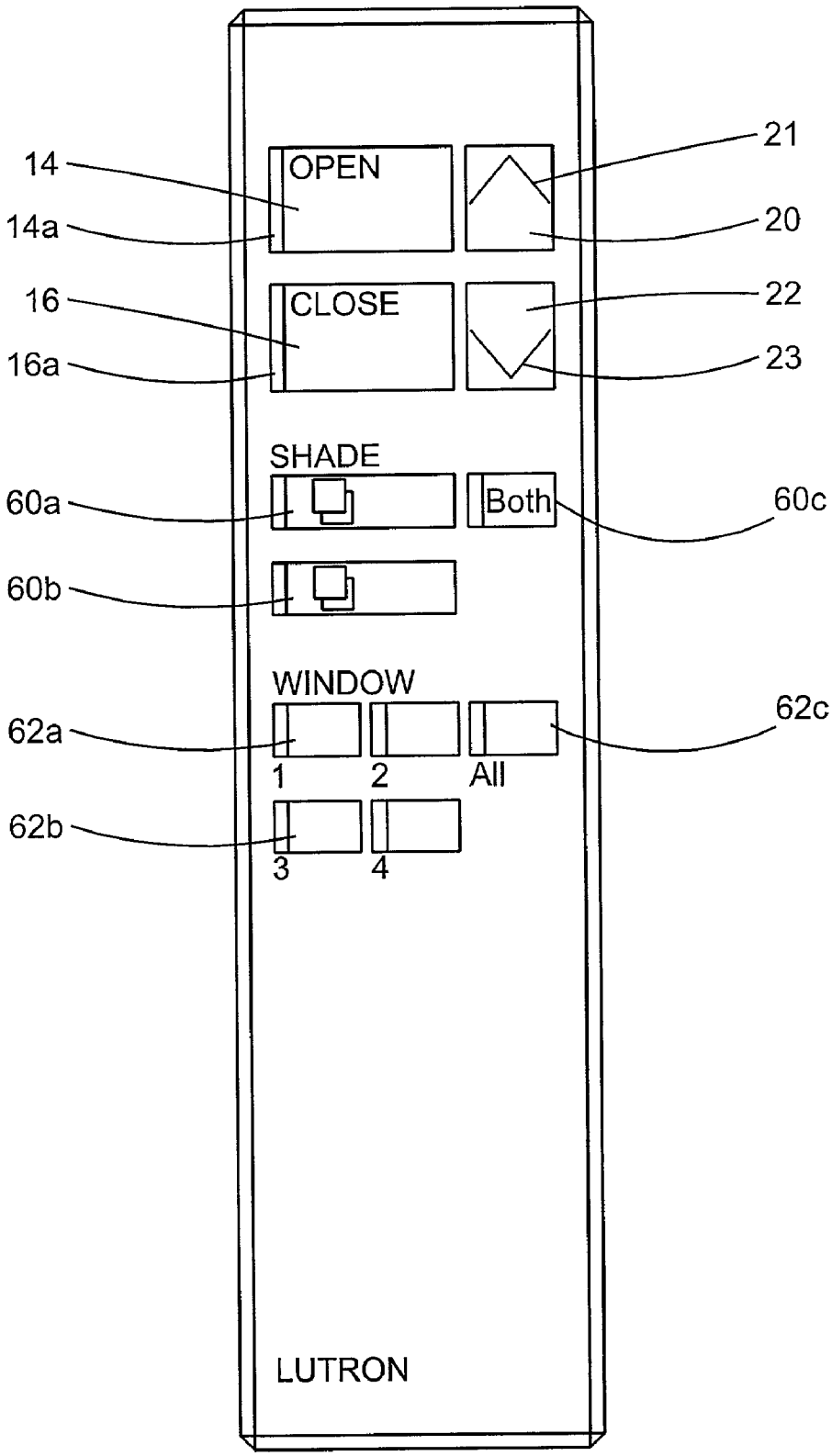
Figure 7C:
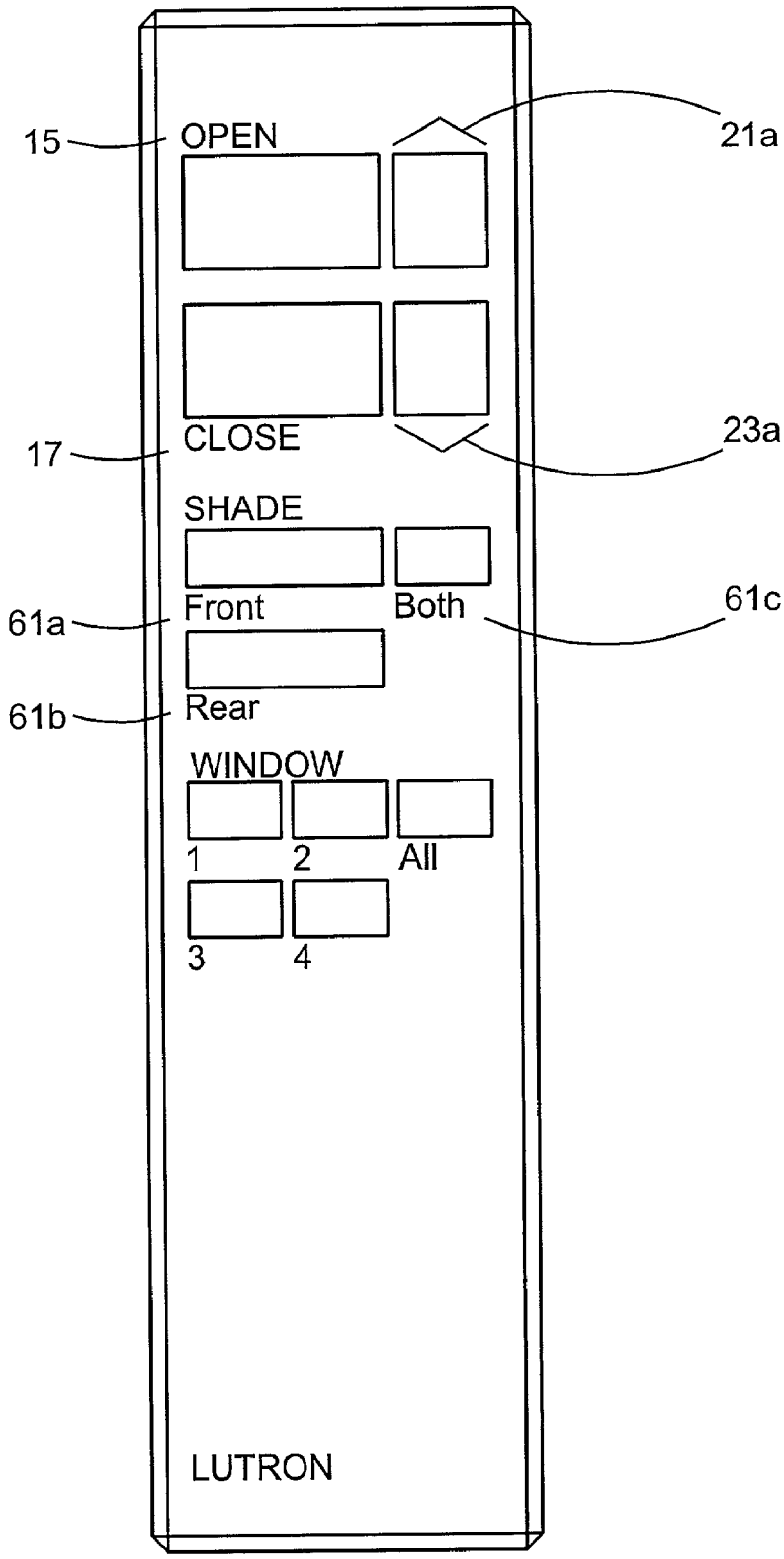
Figure 7D:
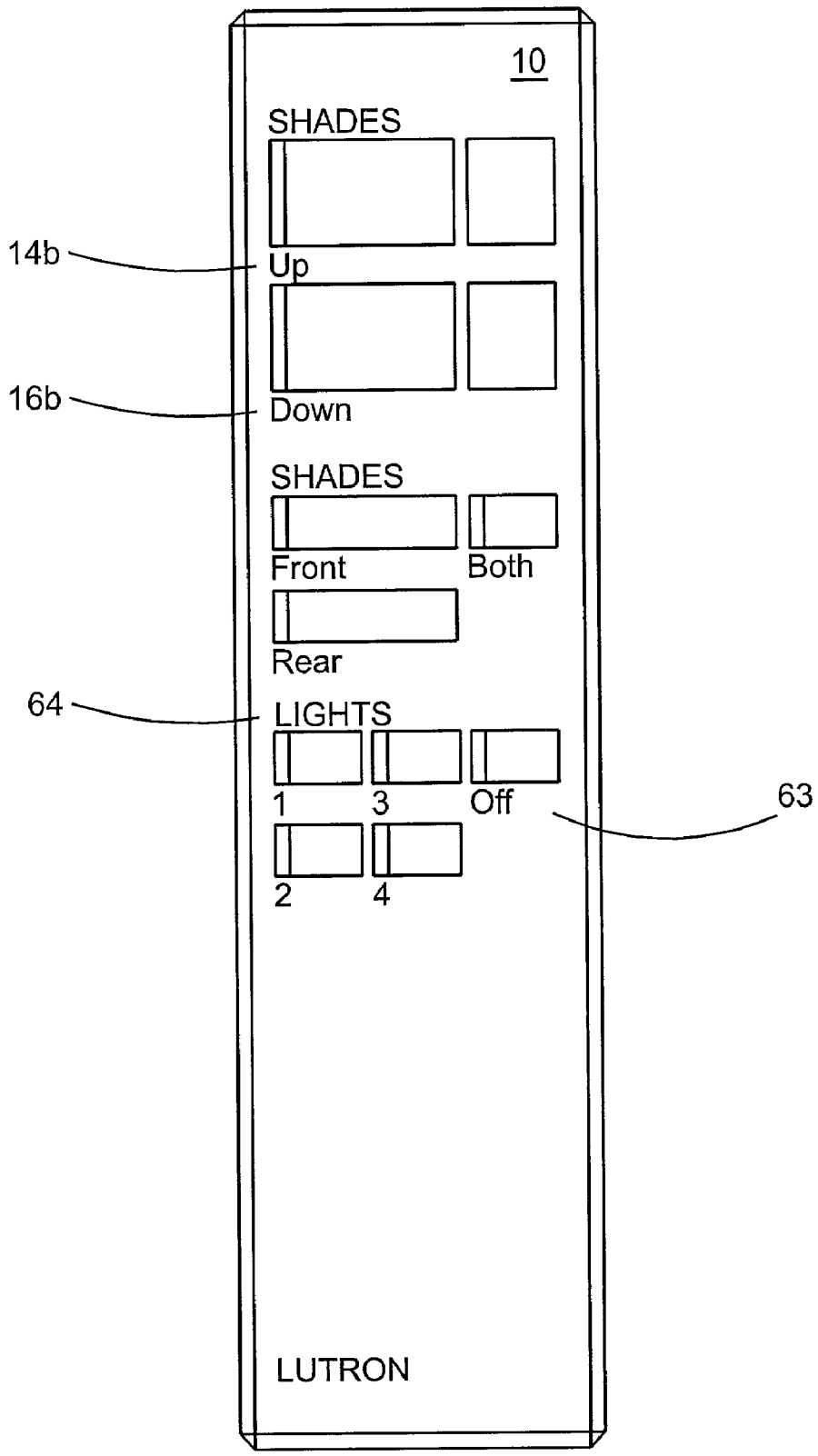
Figure 7E:
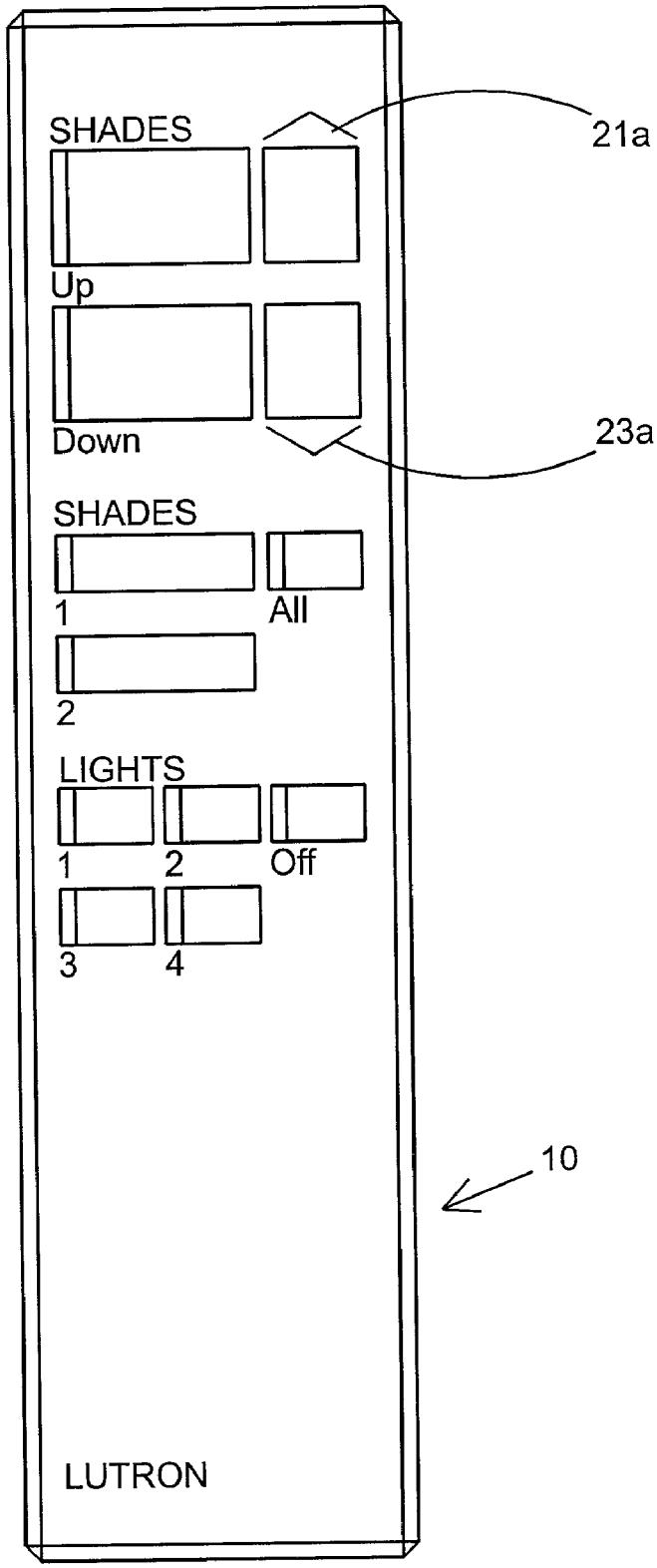
Figure 7F:
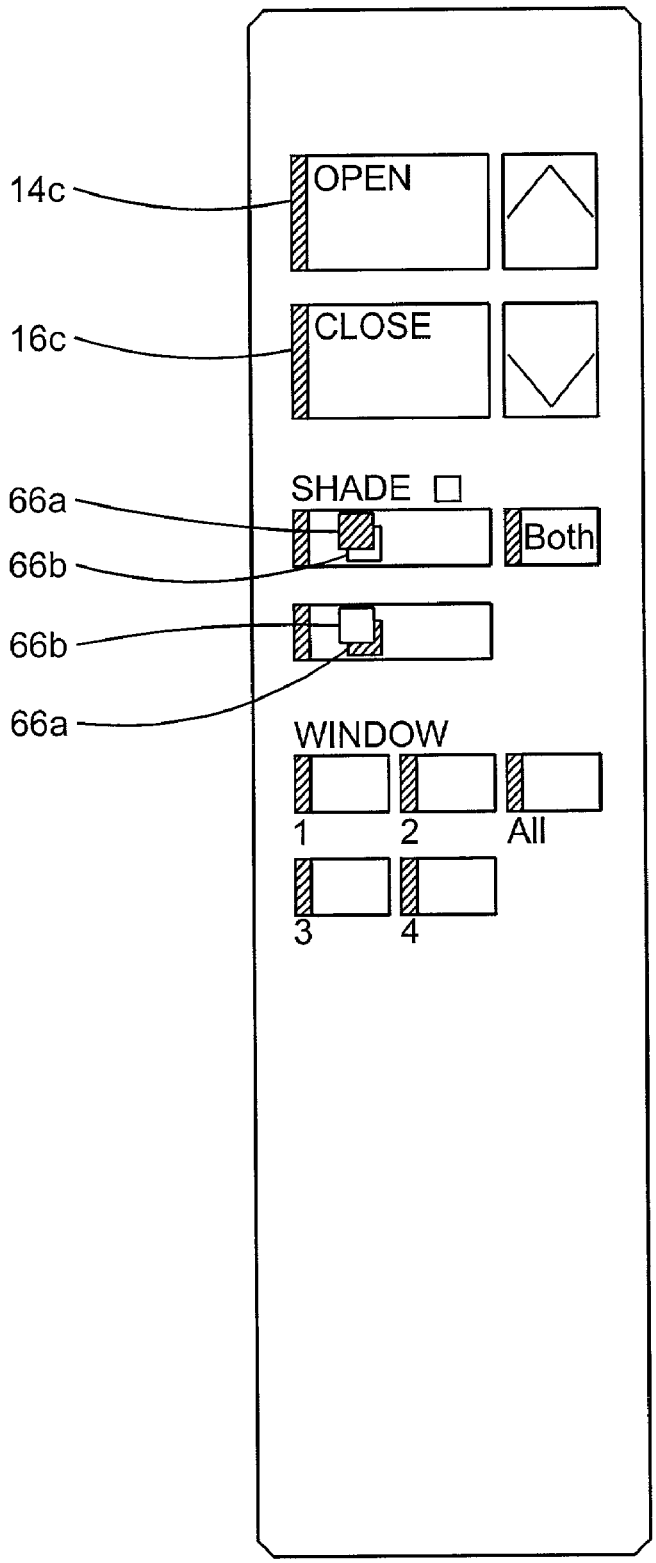

FIG. 7C differs from FIG. 7B in the icons 21*a*, 23*a*, 15, 17, 61*a*, 61*b* and 61*c* being located off but adjacent their respective buttons. Further icon placement variations are shown in FIGS. 7D, 7E and 7F. In FIG. 7F, the dark, vertically oriented bands on the various buttons can be mere decals or they can be LED lamps that will light up to indicate when a particular button has operated or when a particular selection has been made. The elements 66*a* and 66*b* on the shade control buttons are additional icons representing which shade is the "active" shade.

The foregoing description of various devices and properties or parameters to be controlled by the remote control of the present invention is extendable to a virtually limitless list of other devices and parameters. Thus, the remote control of the present invention is intended to be applicable to such devices as audio/video equipment, projection screens, motorized sky lights, various doors, e.g., garage doors, heating and cooling appliances, cooking appliances, and the like. The parameters or variables of these appliances include such variables as temperature, heat capacity, light, sound, humidity, ventilation, and other electrical and mechanical properties such as, for example, torque, pressure, force, power, energy, speed, etc.

In accordance with the further concept illustrated in FIG. 3, the various control buttons need not be square or rectangularly shaped. They can be shaped to allow immediate association with the device being controlled. Thus, the buttons for controlling a light may be shaped to convey the image of a light fixture, a button for a roller shade can be in the shape of a roller shade symbol and so on. These shapes include the shapes 31*a* and 31*b* for "light-off" and "light-on", respectively; 31*c* and 31*d* for "shade down" and "shade up", respectively; 31*e* and 31*f* for "roman shade down" and "roman shade up", respectively; and 31*g* and 31*h* for "drapery close" and "drapery open", respectively. Alternatively, the shapes 31*a*–31*h* can be used as decals on differently shaped buttons.

Thus, as described above, in accordance with the various embodiments of the present invention, the invention is directed to a hand-held remote control that includes at least the following features and functionalities. The device is a hand-held remote control for controlling at least two device types chosen from a group that includes lights, roller shades, draperies, and any of the devices listed above or even others. The device includes a plurality of buttons in ordered arrangement, with all buttons relating to a single device type grouped together, within each device type group organized as a first pair of proximate buttons operable to cause the associated device type to go to one of two extreme states, and a second pair of proximate buttons operable to cause the associated device type to go to a state intermediate said two extreme states.

The control device can be a multiple device type hand-held remote control with all buttons associated with a single device type grouped together with each group including a pair of course adjust buttons and a pair of fine adjust buttons. This generic multiple device type can be configured with each pair of proximate buttons being differently sized from the other of said pair of proximate buttons within each device type button group. The relative size of each pair of buttons can be related to the magnitude of the change the particular pair of buttons is capable of controlling. Or the shape of the buttons in the device type group can be the same and be related to the device type. Or, the shape for each device type group can be different from the shapes of all of the other device type groups. The shape of each button within each device type group can be different and related to the function performed by that button. Functionally corresponding buttons in different device type groups can have the same shape. And, the shape of a button can be a visual representation of the end result achieved by actuating the button.

The various features noted above can be selected for any particular implementation of the remote control of the present invention by choosing the features to evolve a particular remote control having a specific selection of features and functionalities and appearance. Those functionalities and features further include each pair of proximate buttons being spaced vertically from each other and each pair of proximate buttons being spaced horizontally from each other and/or each pair of proximate buttons being axially spaced from each other, and the pair of buttons within each device type group being axially spaced from the other pair of proximate buttons orthogonally to the first pair. Buttons can also be differentiated based on their functionality being different as indicated by button color, texture, material, tactile feel and the like. The remote control can have each button provide a single function different from all other functions within each device group. Similarly, buttons can have decals formed directly thereon or adjacent thereto which are different from all of the decals associated with other buttons within each group.

Figure 8A:
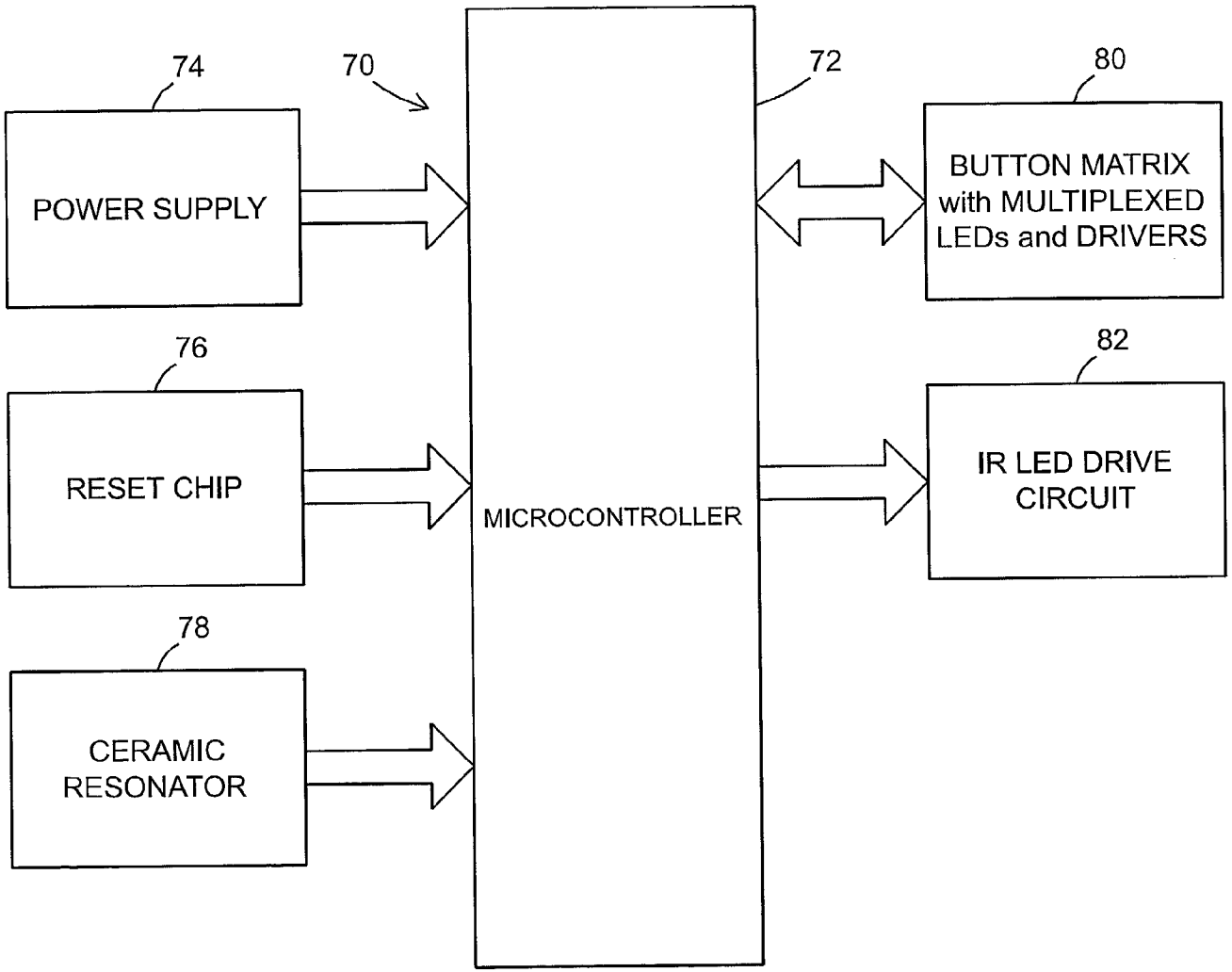
FIGS. 8A and 8B are block diagrams showing major circuit and software sections of the hand-held remote control of the present invention.
Figure 8B:
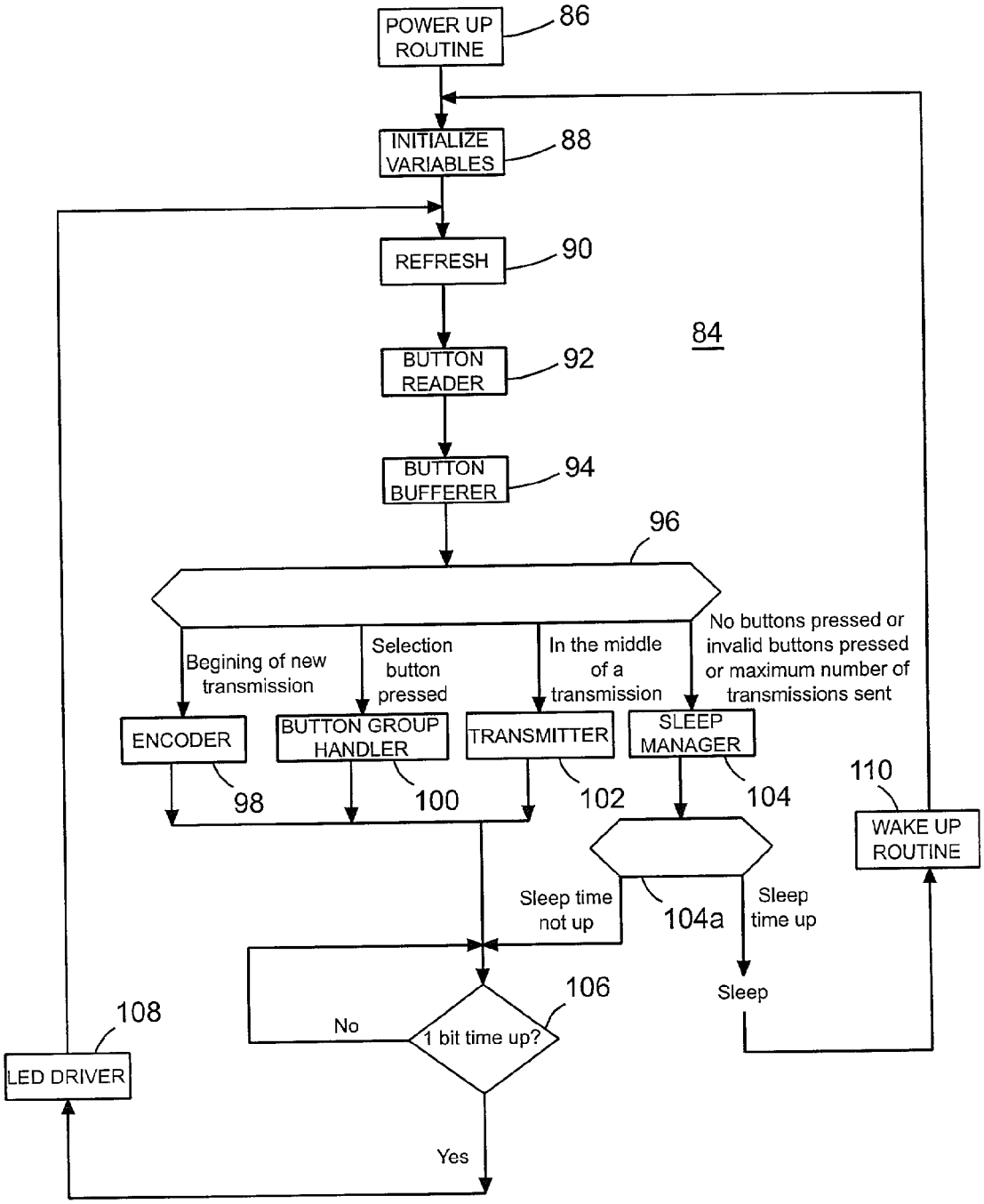

The operation of the various remote control 10 is elucidated by the circuit and software block diagram of FIGS. 8A and 8B. In FIG. 8A, the system 70 includes a microcontroller 72 and other electronic components that are powered by a power supply 74, e.g., a battery. A reset circuit 76 is coupled to the microcontroller and a ceramic resonator 78 provides the basic clock signal that controls the sequential steps of the computer instructions executed within the microcontroller 72.

For input/output, the button matrix block 80 comprises the circuitry that senses and communicates to the microcontroller 72 which buttons have been depressed and/or which indicators on the face of the control 10 need to be illuminated. The actual drive signals for LED or other display devices are supplied to the LED drive circuit 82.

As shown in FIG. 8B, the software 84 implements an algorithm that executes a power-up routine at block 86 when the device is first turned on and proceeds to carry-out the initialization of various variables at step 88. The refreshing of button positions and other functions within the system 70 is carried out by the software at block 90. The button reader 92 constantly queries the various buttons as part of the overall process 84, noting which buttons have been depressed and storing those settings in a table or register 94.

The overall process nerve center at 96 selects one of a plurality of functions such as those provided in the encoder block 98, button group handling block 100, the transmitter block 102 and the sleep manager 104 which handles power conservation. Based on the determination at the decision block 104*a*, when the sleep time has been determined to have run, the wake up routine 110 is invoked and the process then repeats as indicated. If the sleep time has not run up, then the decision block software 106 queries whether the 1 bit time is up and proceeds to refresh the driver, so that the LEDs are properly strobed to obtain the proper display visibility.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An ergonomic control device for the setting of a given first respective variable physical property of a first structure between a maximum setting and a minimum setting, and at least a second respective variable physical property of a second structure between a maximum setting and a minimum setting; each of said first and second structures having a respective control input connected thereto for adjusting said first and second variable properties to any of a plurality of settings between said maximum and minimum settings; said control device having first, second, third and fourth separate manually operable control elements which are operatively connected to said respective control inputs; said first and second control elements being operable to set said first and second variable properties of said first and second structures, respectively, at said maximum setting and said minimum setting respectively; said third and fourth control elements being vernier controls and being respectively operable to adjust said first and second variable properties from said maximum setting and toward said minimum setting, and to any of said plurality of settings and from said minimum setting and toward said maximum setting and to any of said plurality of settings; and wherein at least one of said first, second, third or fourth control element of said control device is operable to select said first and second structures for setting said first property or said second property.

2. The control device of claim 1, wherein said control device is a portable hand-held unit with an infrared coupling system to couple said control device to said respective control inputs; said control elements being arrayed over a surface of said portable handheld unit for manual operation by a user.

3. The control device of claim 1, wherein only a single one of said first, second, third and fourth control elements are individually operable at any time to initiate the setting of said first or said second variable property.

4. The control device of claim 1, wherein said control elements are depressible switch elements.

5. The control device of claim 1, wherein said second structure is controlled by fifth, sixth, seventh and eighth control elements which are identical to said first, second, third and fourth control elements respectively for controlling said second variable property of said second structure in a process identical to the control of said first structure.

6. The device of claim 1, wherein at least one of said first and second structures is a lamp and said respective variable physical property is the luminous output of said lamp.

7. The device of claim 1, wherein at least one of said first and second structures is a motor operated window covering and said respective variable physical property is the percentage of coverage of a window by said window coverage.

8. The device of claim 7, wherein said window covering is a vertically moveable shade.

9. The device of claim 7, wherein said window covering is a laterally moveable drapery.

10. The device of claim 1, wherein said plurality of settings varies between said maximum and minimum settings.

11. The device of claim 1, wherein said first structure comprises a lamp, and said second structure comprises a motor driven device.

12. The device of claim 1, wherein said first and third control elements are laterally adjacent one another, and wherein said second and fourth control elements are laterally adjacent one another, and wherein said first control element is disposed vertically above said second control element, whereby the operation of said control elements is easily discernable to a user from the placements of said control elements.

13. The device of claim 2, wherein said first and third control elements are laterally adjacent one another, and wherein said second and fourth control elements are laterally adjacent one another, and wherein said first control element is disposed vertically above said second control element, whereby the operation of said control elements is easily discernable to a user from the placements of said control elements.

14. The control device of claim 1, further including a preset button operatively connected to said control input and said preset button being operable to set said variable property of said structure at a preset value.

15. The process of adjusting a single respective given physical property of at least two respective apparatuses in which at least one respective physical property of said at least two apparatuses is adjustable between minimum and maximum values; said process comprising the steps of activating only one of a first and a second control element to set said respective physical property at its minimum or maximum value respectively; and thereafter selectively activating only one of a third and fourth control element to readjust said physical property in a vernier manner from said minimum value, or from said maximum value, respectively, and toward an intermediate setting between said minimum and maximum values.

16. The process of claim 15, wherein the sequence of operation of said first and then third, control elements or of said second and then fourth control elements, is suggested to the user by locating said first and third elements laterally adjacent to one another and by locating said second and fourth control elements laterally adjacent one another; and by locating said second control element, vertically above said first control element.

17. The process of claim 15, further including selecting to activate neither of said third and fourth control elements and selecting instead, to actuate a preset control element to adjust said given physical property at a preset level between said minimum and maximum values.

18. The process of adjusting at least two respective electrical loads from a portable hand held remote control device which has at least first, second, third and fourth manually operable control elements on surface thereof for producing control signals for operating said respective electrical loads in accordance with respective first, second, third and fourth values, which are maximum energization, minimum energization, a continually decreasing energization to a selected respective value, and a continuously increasing energization to a selected value; said process comprising the sequence of first manually operating either said first and then said third control elements, and thereafter operating either of said second and fourth control elements until a desired selected value on at least one of said electrical loads is achieved.

19. The process of claim 18, wherein the sequence of operation of said first and then third or said second and then fourth control elements is suggested to the user by locating said first and third elements laterally adjacent to one another and by locating said second and fourth control elements laterally adjacent one another; and by locating said second control, vertically above said first control.

20. The process of claim 18, wherein said electrical load is a lamp.

21. The process of claim 18, wherein said electrical load is a motor.

22. An ergonomic hand-held control device for controlling the setting of at least two respective electrically controlled appliances, each having a physical property adjustable between a maximum setting and a minimum setting and at intermediate positions therebetween, the control device comprising a first pair, including first and second buttons that are vertically aligned on a face plate of the control device and a second pair comprising respective first and second buttons that are vertically aligned relative to one another, and horizontally aligned with the first pair of buttons, and an electronic circuit in the control device that is associated with the first and second pair of buttons and so operable as to cause the variable property to assume its maximum setting when the first button of the first pair is actuated, to assume the minimum setting when the second button of the first pair is actuated, continuously increase its setting value when the first button of the second pair is activated and continuously decrease its setting when the second button of the second pair is actuated; and the control device further having third and fourth pairs of buttons, each comprising, respectively, first and second buttons for controlling another appliance.

23. The control device of claim 22, wherein the control device includes an infrared coupling system to couple the control device to a control input of the appliance.

24. The control device of claim 22, further including a preset button that is operable to set the physical property at a preset value.

25. The control device of claim 22, including a plurality of icons associated with the buttons.

26. The control device of claim 25, wherein the first button of the second pair comprises icons in the form of arrows that point away from one another.

27. The control device of claim 26, in which icons are formed as white on white line drawings.

28. The control device of claim 26, in which icons are formed as black on white representations.

29. The control device of claim 26, in which icons are formed as white on black representations.

30. The control device of claim 22, further including a plurality of pictorial icons selected from a group consisting of icons that picture a light, a drape, a roller shade and a roman shade.

31. The control device of claim 22, further including fifth and sixth groups of buttons, each comprising a respective first and second buttons for controlling a further appliance.

32. The control device of claim 22, wherein the appliance and the second appliance constitute, respectively, lights and drapes.

33. The control device of claim 22, wherein the appliance and the second appliance constitute, respectively, lights and roller shades.

34. The control device of claim 22, wherein the appliance and the second appliance constitute, respectively, drapes and roller shades.

35. The control device of claim 31, wherein the appliance, the second appliance and the third appliance comprise, respectively, lights, a roller shade and drapes.

36. The control device of claim 22, further comprising a group of buttons to control the selection of a first, a second, or a combination of first and second shades.

37. The control device of claim 36, including a further switch group for selecting the location of shades relative to a plurality of windows.

38. The control device of claim 22, further including a first and second icons which pictorially show the functions of the first and second buttons of the second group and the first and second icons being located adjacent to but off the first and second buttons of the second group.

39. The control device of claim 36, in which the first shade and the second constitute front and rear shades located on the same wall opening.

40. The control device of claim 22, further comprising illumination elements incorporation in at least two of the buttons.

41. The control device of claim 40, in which the electronic circuit comprises a button matrix with multiplexed LEDs and drivers circuitry.

42. The control device of claim 22, in which the electronic circuit comprise software that provides a sleep manager function.

* * * * *